United States Patent [19]

Wray et al.

[11] 4,043,280

[45] Aug. 23, 1977

[54] INCINERATOR

[75] Inventors: Stanley William Wray, Poole; Michael George Warwick, Guildford, both of England

[73] Assignees: Hamworthy Engineering Limited, Poole; P.D. Pollution Control Limited, Rickfords Hill Aylesbury, both of England

[21] Appl. No.: 657,392

[22] Filed: Feb. 12, 1976

[30] Foreign Application Priority Data

Feb. 18, 1975 United Kingdom ..... 6788/75

[51] Int. Cl.[2] ..... F23G 7/00; F23B 1/16

[52] U.S. Cl. ..... 110/7 R; 110/37; 110/7 B

[58] Field of Search ..... 416/240; 110/7 R, 7 B, 110/8 R, 8 C, 13, 36, 37; 126/182

[56] References Cited

U.S. PATENT DOCUMENTS

| | | | |
|---|---|---|---|
| 2,660,966 | 12/1953 | Lyons | 110/37 |
| 3,223,290 | 12/1965 | Schuld | 416/240 |
| 3,605,656 | 9/1971 | Stribling | 110/13 |
| 3,671,167 | 6/1972 | Nakano | 110/7 |
| 3,824,935 | 7/1974 | Yamato et al. | 110/13 |

*Primary Examiner*—Kenneth W. Sprague

*Attorney, Agent, or Firm*—Parmelee, Miller, Welsh & Kratz

[57] ABSTRACT

In a cylonic incinerator for burning liquid and solid wastes, one or more scraper bars are suspended by a non-rigid suspension from support arms projecting from a vertical driven shaft, so as to spread and disturb the waste on the floor of the incinerator.

9 Claims, 2 Drawing Figures

INCINERATOR

This invention relates to waste incinerators and in particular to incinerators of the "cyclone" type. The invention is applicable for example to marine and industrial incinerators for burning simultaneously or separately general refuse, waste oil, oily water, screenings and sludge from sewage or effluent treatment plant.

A problem which arises when waste material is burnt in a small incinerator is that of ensuring adequate access of air for combustion to the waste, which commonly forms a heap on the floor of the combustion chamber.

The use of rigid distributor to spread the waste is unsatisfactory because the waste will commonly include relatively large incombustible bodies such as bottles and tin cans, which jam the distributor.

According to the present invention we provide a waste incinerator, comprising a combustion chamber having a floor, at least one distributor member adjacent to the floor, at least one support member spaced above the floor, non-rigid suspension means suspending the or each distributor member from an associated said support member, driving means for moving the support member or members above the said floor to cause the distributor member or members to sweep at least part of the floor area, and a loading aperture for solid waste.

Because of the non-rigid suspension of the distributor member, it can ride over solid obstructions which would impede a rigid member.

The distributor member may be of substantial horizontal extent, e.g. a metal bar suspended by pivoted links or chains from a movable arm. Alternatively we may provide a plurality of relatively small distributor members which together sweep the combustion chamber floor, e.g. a plurality of lengths of chain or pivoted fingers suspended from a movable arm.

In a preferred arrangement the distributor member is a metal bar of inverted T-section, one arm of the cross-piece of the T forming an uninterrupted blade and the other arm of the cross-piece being toothed.

Preferably, the combustion chamber floor is provided with a closure giving access to an ash receptacle, so that the distributor member or members can be used to push ash and other solid residues such as bottles and pieces of metal, into the ash receptacle after combustion.

The distributor member or members and/or support member or members may constitute air conduits with outlets for directing air onto the waste material.

An incinerator embodying the invention is shown by way of example in the accompanying drawings, in which.

Figure 1:
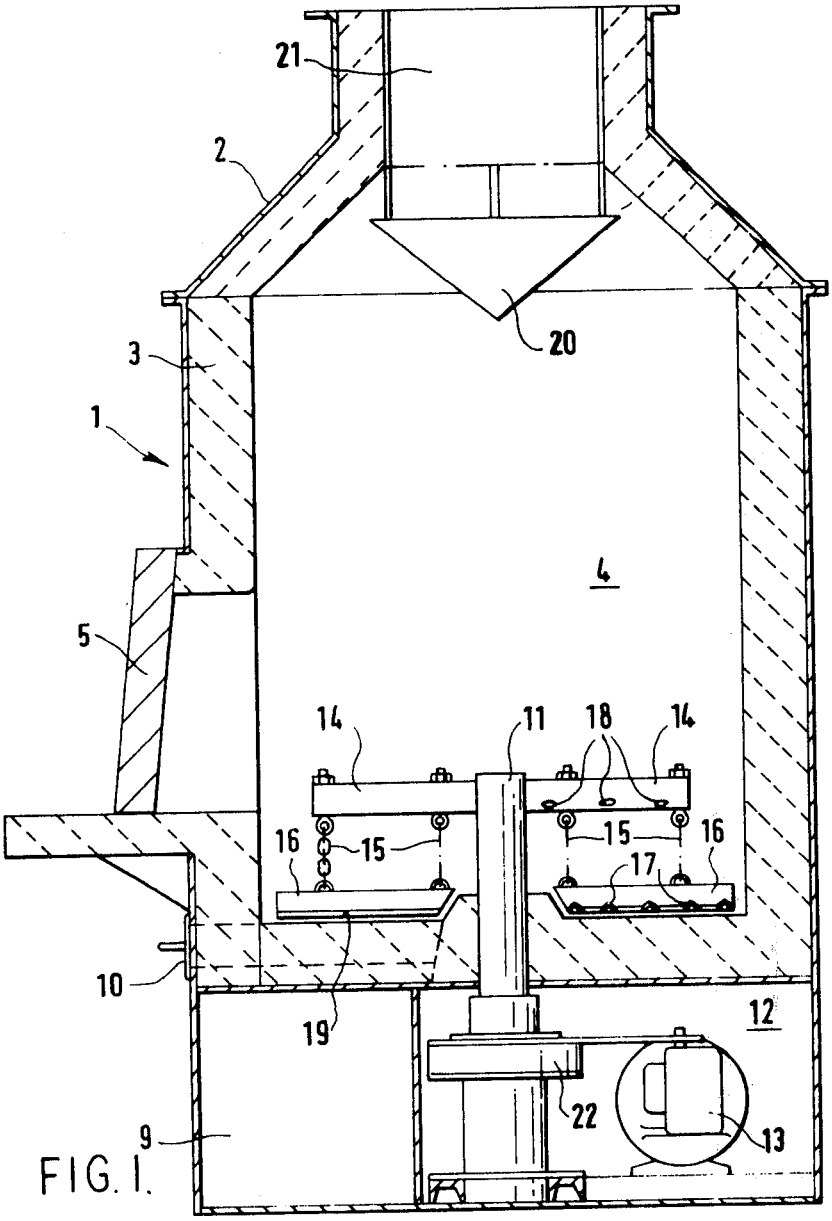
FIG. 1 is a side view, in section on the line A–A of FIG. 2.
Figure 2:
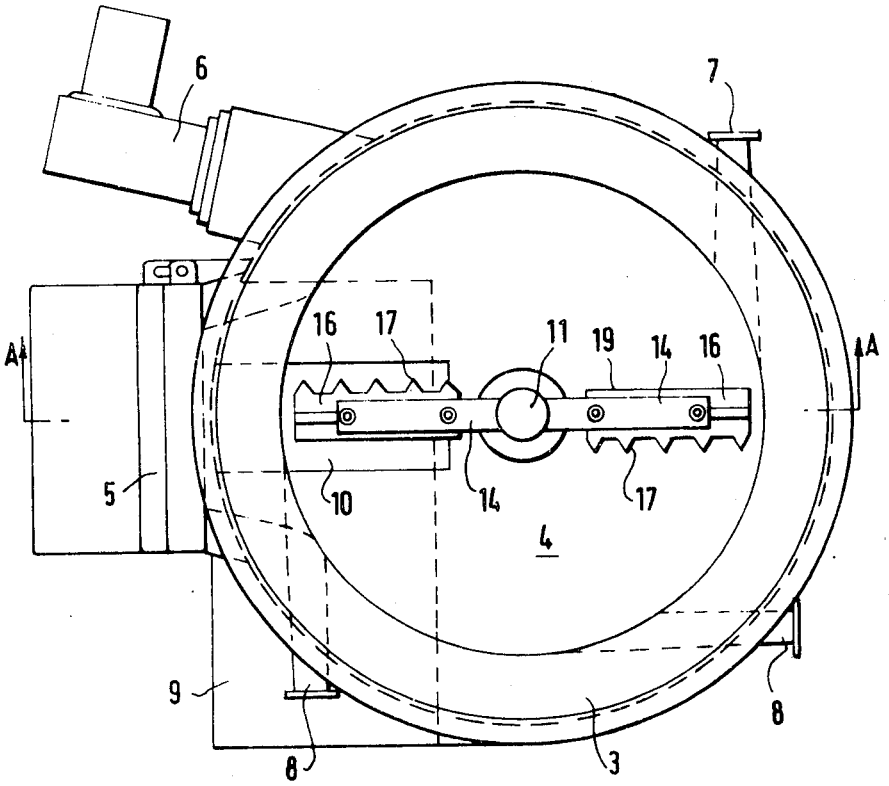
FIG. 2 is a plan view of the incinerator with its cover removed.

The illustrated incinerator is of the cyclone type in the form of a vertical cylinder 1 with a tapered cover 2 leading to a flue. The incinerator comprises a steel shell with a refractory lining 3 defining a combustion chamber 4. A loading door 5 is provided for insertion of waste material, which may be fed in manually in plastics or paper sacks, or automatically by a mechanical feed system. The incinerator is also provided with a tangentially arranged auxiliary burner 6, a tangential inlet port 7 for liquid waste, and at least one tangential inlet port 8 for combustion air, arranged to produce a cylonic motion in the gases in the chamber 4.

Below part of the hearth is an ashbox 9 normally closed off from the combustion chamber by a slide 10.

A vertical shaft 11 mounted on a bearing 22 extends through the centre of the hearth through a space 12 below the combustion chamber which space accommodates an electric motor and gearbox 13 for rotating the shaft. The shaft is coaxial with the combustion chamber. At the top of the shaft are mounted diametrically opposite support arms 14. From each of these is suspended by means of chains 15 or suspension rods a steel scraper bar 16 of inverted T-section whose underside is suspended just clear of the hearth. Each scraper bar has teeth 17 on one edge, to grip the refuse as the bars are rotated by means of the shaft 11 and support arms 14. The other edge is a single uninterrupted blade 19. When dealing with waste which contains large objects e.g. tin cans and bottles the shaft is rotated in a direction such that the blade 19 is the leading edge of the bar. Any of these large objects will ride over or pass under the bar and do not cause an obstruction. When dealing with wastes which contain no such objects but which contain a high proportion of sewage sludge, oily sludges or other types of sludges, pastes or cakes, the direction of rotation is reversed (the motor or gearbox being reversible) so that the angled teeth dig into the material and agitate it to promote more effective combustion. In both directions of rotation the scraper bars spread the waste material evenly over the hearth and also disturb the material thereby ensuring good access of combustion air.

After combustion, the slide 10 is withdrawn to open the ashbox. The scraper bars continue to rotate so as to push into the ash box any ash or solid residues.

From there the ash can be removed either by a manually or automatically operated slide, or by a conveyor, or by a combination of slide and conveyor, or by some other suitable means.

The arms 14 are normally clear of the waste material and the scraper bars, as already described, are not rigidly mounted. Consequently neither the arms nor the bars are likely to become jammed by the waste material.

The shaft 11 and arms 14 are hollow and the arms are provided with air outlets 18, directed forwards and downwards, to feed combustion air to the waste material. The air is supplied to the shaft from a fan (not shown but sited in space 12) and serves also to cool the shaft and arms.

It is desirable to make the arms 14 readily removable from the shaft, so as to permit a different type of distributor mechanism to be inserted. This can conveniently be done by making the connection between the shaft and the arms in the form of a spigot/socket joint.

Below the furnace exit an inverted cone 20 is fitted to direct the gases outwards away from the axis of the incinerator so that the flue gases leaving the incinerator undergo a sharp change in direction thereby causing solid matter to be thrown away from the exit and not carried out with the flue gases.

Additionally in the flue 21 a device (not shown) is fitted to prevent paper char from being carried out with the flue gases and at the same time to entrain cold air to cool the flue gases as they pass up the flue. This entrained air also keeps the paper char screen cool, preventing it from overheating.

We have found that a suitable rate of rotation for the rotary arms and scraper bars is 2 rpm.

Although a simple circular rotary movement is appropriate in most cases, the movement of the scraper bars can alternatively be oscillatory. The movement may be intermittent rather than steady. The invention is applicable to non-circular incinerators, the arrangement and movement of the scraper member or members being modified accordingly, e.g. to carry out a rectilinear movement.

The liquid waste burner 6 is designed to burn any mixture of waste oil, oily water and/or sewage or other sludges which may contain solid particles of up to approximately 12 mm in size and consists of a specially shaped tube through which is fed low pressure combustion air to provide a curtain of air onto which is fed the liquid waste through a feed pipe and guides. The liquid waste is thereby atomised as it enters the combustion chamber.

Loading door 5 is provided with a double tadpole section asbestos seal, and to ensure that the seal between the furnace and the door is maintained dust proof under all conditions, compressed air at 15 lbs per square inch gauge is applied to the space between the asbestos seals, e.g. through a duct extending in the door frame around the door opening.

We claim:

1. A waste incinerator, comprising a combustion chamber having a floor, at least one generally horizontal metal distributor bar adjacent to the floor, at least one support member spaced above the floor, non-rigid suspension means suspending at least one said distributor bar from an associated said support member, reversible driving means for moving the support member or members above the said floor to cause the distributor bar or bars to sweep at least part of the floor area, and a loading aperture for solid waste, at least one said non-rigidly suspended bar having a toothed edge and, opposite the toothed edge, a further edge forming a continuous blade.

2. An incinerator as in claim 1 wherein the non-rigid suspension means are adapted to permit the bar or bars suspended thereby to swing to either side of a normal rest position.

3. An incinerator as claimed in claim 2 in which the non-rigid suspension means comprises at least one chain.

4. An incinerator as claimed in claim 1 in which the bar is of inverted T-section.

5. An incinerator as claimed in claim 1 in which at least one said member constitutes air conduit means with outlets arranged to direct air onto the waste material on the combustion chamber floor.

6. An incinerator as claimed in claim 1 having a combustion chamber of circular cross section, the support member(s) being rotatable about the axis of the chamber.

7. An incinerator as claimed in claim 6 having a tangentially arranged burner and at least one tangentially arranged air inlet, arranged to produce a cyclonic motion in the gases in the chamber.

8. An incinerator as claimed in claim 7 having a tangentially arranged inlet for liquid waste.

9. An incinerator as claimed in claim 1 having below the floor an ash receptacle and in the floor a removable closure for providing access to the ash receptacle.

* * * * *